United States Patent [19]

Jennings

[11] Patent Number: 4,901,638

[45] **Date of Patent: * Feb. 20, 1990**

[54] PAINTER'S CAP PRINTING

[75] Inventor: Roger L. Jennings, Glens Falls, N.Y.

[73] Assignee: R. Jennings Manufacturing Co., Inc., Glens Falls, N.Y.

[ * ] Notice: The portion of the term of this patent subsequent to Mar. 27, 2001 has been disclaimed.

[21] Appl. No.: 866,562

[22] Filed: May 23, 1986

Related U.S. Application Data

[60] Division of Ser. No. 548,343, Nov. 3, 1983, Pat. No. 4,612,856, which is a continuation-in-part of Ser. No. 441,672, Nov. 15, 1982, Pat. No. 4,438,693.

[51] Int. Cl.[4] ..... B41F 17/00

[52] U.S. Cl. ..... 101/126; 101/35; 101/129

[58] Field of Search ..... 101/35, 41, 114, 115, 101/123, 126, 129, 407 BP; 108/69; 248/231.7; D18/22

[56] References Cited

U.S. PATENT DOCUMENTS

| | | | |
|---|---|---|---|
| 224,030 | 2/1880 | Mussells et al. | 101/41 X |
| 1,252,043 | 1/1918 | Shourt | 101/38 A |
| 2,321,134 | 6/1943 | Fleisher et al. | 101/126 |
| 2,872,259 | 2/1959 | Thorpe | 108/69 |
| 2,942,921 | 6/1960 | Rachman et al. | 108/26 |
| 3,131,900 | 5/1964 | Anderson et al. | 248/231.7 X |
| 4,266,476 | 5/1981 | Maloof | 101/35 |
| 4,438,693 | 3/1984 | Serrianne et al. | 101/35 X |
| 4,509,420 | 4/1985 | Stroffolino | 101/126 X |
| 4,612,856 | 9/1986 | Jennings | 101/129 |

*Primary Examiner*—Clifford D. Crowder
*Attorney, Agent, or Firm*—Nixon & Vanderhye

[57] ABSTRACT

A method and apparatus for silk screen printing the tops and fronts of completed painter's cap. An oval-shaped platen is dimensioned so that a painter's cap fits over it, the bottom of the top portion of the painter's cap engaging the platen and held to the platen by an adhesive. A silk screen may be pivoted into contact with the cap top while mounted on the platen. For printing the front of a painter's cap, a saddle secured to a frame and having a flat platen which supports the cap front is provided. The flat platen of the saddle is spaced from a registration plate is essentially linear and spaced with respect to the registration plate so that it does not interfere with a hem of the cap between the front and top thereof. A rear blocking member is removably mounted to the rear edge of the flat platen so that the saddle may also be used effectively to print the front panels of baseball-type caps.

16 Claims, 2 Drawing Sheets

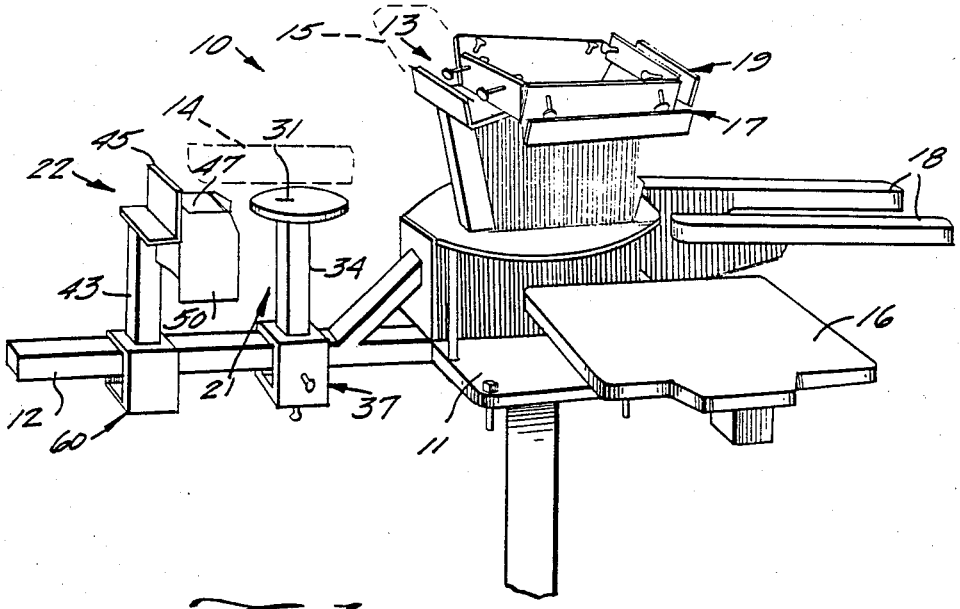
Fig. 1
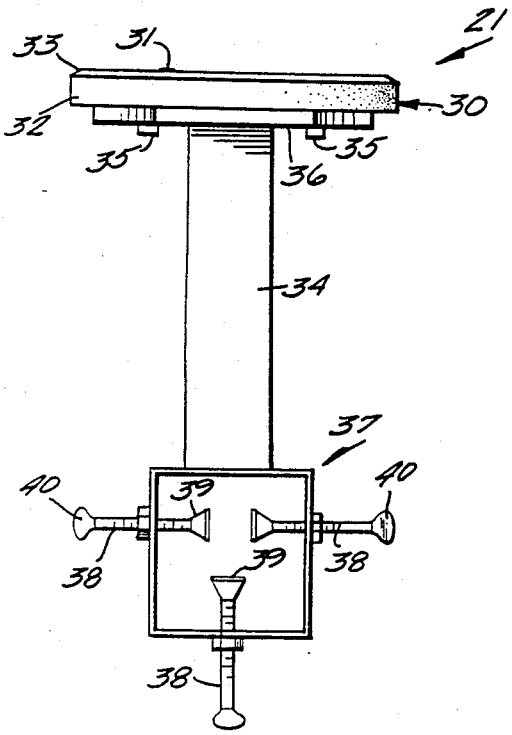
Fig. 2
Fig. 3
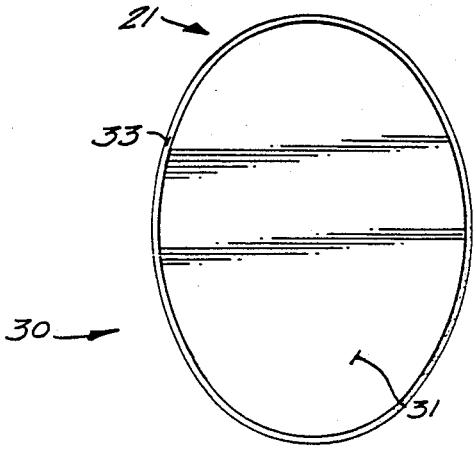

PAINTER'S CAP PRINTING

CROSS-REFERENCE TO RELATED APPLICATION

This application is a division of application Ser. No. 548,343 filed Nov. 3, 1983, now U.S. Pat. No. 4,612,856. This application is also a continuation-in-part of U.S. application Ser. No. 441,672 filed Nov. 15, 1982 and now U.S. Pat. No. 4,438,693, and which was co-pending with parent application Ser. No. 548,343 filed Nov. 3, 1983.

BACKGROUND AND SUMMARY OF THE INVENTION

In U.S. Pat. No. 4,438,693, a method and apparatus are described for effective silk-screen printing of a cap of the type having a sweatband and a bill. While the invention shown and described in said patent is extremely effective for printing the fronts of baseball-type caps, there are some painter's caps—which are also caps of the type having a sweatband and bill—which cannot be effectively printed thereby.

Painter's caps commonly have a hem between the top and front panels thereof, and the hem on some painter's caps is located relatively close to the cap bill, such that the printing device illustrated and described in said patent cannot be used effectively to print the front of such painter's caps.

According to the present invention a cap printing device is provided which allows printing of essentially all types of caps having a sweatband and a bill, including baseball-type caps and painter's caps. The printing device according to the invention includes—like the device disclosed and illustrated in said patent—a saddle secured to a frame member and having a flat platen which supports the front panel of a cap; a registration plate against which the bill of the cap presses when the cap is mounted on the saddle, the registration plate being secured to the frame in a spaced-apart relationship with the printing plate; and means for movably securing a silk screen to the frame for movement between an advanced position wherein the printing screen contacts the front of the cap mounted on the saddle, and a retracted position wherein the screen is withdrawn. According to the present invention, however, the platen has a substantially linear rear edge portion opposite the registration plate. The rear edge portion is shaped—and positioned with respect to the registration plate—so that a painter's cap front may lie flat thereon, with no portion of the platen interfering with the hem of the painter's cap.

Also according to the invention a saddle plate rear blocking member for shaping the top of a baseball-type cap during printing thereof is provided, as well as means for mounting the rear blocking member with respect to the platen so that the rear blocking member is movable from a first position—wherein it operatively engages the rear edge portion of the platen and provides an extension thereof—to a second position—wherein it is completely out of operative engagement with the rear edge portion of the platen. This allows the same printing device to be readily used for printing the fronts of painter's caps—when the platen rear blocking member is in inoperative position—and baseball-type caps—when the platen rear blocking member is in operative association with the platen.

When working with painter's caps it is also often desirable to print the tops of the caps, as well as—or instead of—the fronts thereof. In the past, it has been known to silk screen print painter's cap tops, but this has been practiced effectively only before the caps were sewn together. After the caps have been sewn together, it has been extremely difficult—if not impossible—utilizing conventional devices and procedures, to effect clear screen printing of the tops of painter's caps without wrinkling, or other deformation thereof.

A method and apparatus are provided herein which effect appropriate printing of completed painter's caps tops. The apparatus according to the invention comprises a platen assembly including a platen having an oval configuration in plan, and having dimensions generally corresponding to the dimensions of the top of a completed painter's cap. The platen includes a smooth hard top surface and a base supporting the smooth hard top surface, and a taper being provided along the entire periphery of the base at the edge of the top. An elongated support member is affixed to the base on the opposite side thereof as the smooth hard top, and is rigidly connected to a collar at the opposite end thereof as the base. The collar is preferably quadrate in cross-section and includes a plurality of screws extending therethrough, at least two of the screws extending in intersecting planes, so that the position of the collar with respect to an elongated frame member received thereby may be adjusted.

In practicing the method, a painter's cap is mounted on the platen so that the platen is interior of the painter's cap and engages the bottom of the top portion of the painter's cap. The painter's cap is affixed with respect to the platen—as by spraying adhesive onto the platen before bringing the cap into operative association thereof—so that the top of the painter's cap is essentially smooth and in contact with the platen so that there is essentially no relative movement between the cap top and the platen. Then the silk screen is brought into contact with the top of the painter's cap to thereby print indicia on the top of the painter's cap. The painter's cap is removed from the platen after printing.

Utilizing the devices according to the present invention, it is possible to print the front of one painter's cap at the same time that the top of another painter's cap is being printed, with the same silk screen. This is effected by using the platen and the saddle printing plate, so that they are at essentially the same working height, and mounted on a frame so that the positions thereof with respect to the silk screen mounting mechanism may be adjusted.

It is the primary object of the present invention to provide for the effective printing of the tops and/or fronts of painter's caps, and the like. This and other objects of the invention will become clear from an inspection of the detailed description of the invention, and from the appended claims.

BRIEF DESCRIPTION OF THE DRAWINGS

FIG. 1 is a perspective view of an exemplary cap printing device according to the invention, showing a painter's cap top-receiving platen, and a saddle and associated components for facilitating printing of cap fronts, mounted thereon:

FIG. 2 is an end view of the exemplary painter's cap top-receiving platen of FIG. 1;

FIG. 3 is a top plan view of the platen assembly of FIG. 2;

DETAILED DESCRIPTION OF THE DRAWINGS

Figure 4:
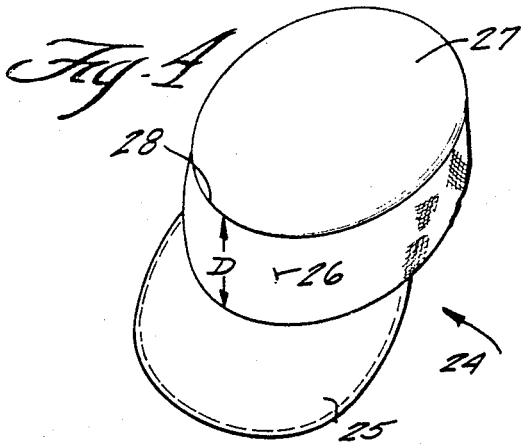
FIG. 4 is a perspective view of a painter's cap which may be utilized in practicing the teachings of the present invention.
Figure 5:
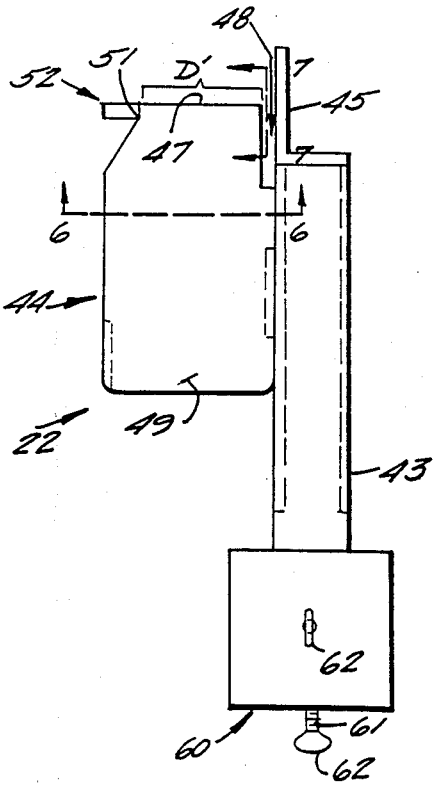
FIG. 5 is a side view of the printing device, with saddle, for printing fronts of caps, of FIG. 1.

FIG. 1 illustrates a printing machine 10 that is utilizable for practicing the method according to the present invention, and with which the printing devices according to the invention are ideally utilized. The device 10 includes a frame 11 including an elongated bar 12 extending therefrom, the bar preferably being quadrate (preferably square) in cross-section. A conventional means, shown generally by reference numeral 13, is provided for movably securing a silk screen to the frame for movement between an advanced position (shown in dotted line by reference numeral 14) wherein the screen operatively contacts a cap or caps being printed, to a retracted position (shown in dotted line by reference numeral 15 in FIG. 1) wherein the screen is withdrawn for changing caps.

The device 10 illustrated in FIG. 1 is also illustrated as having a platen 16 associated therewith, with another screen holding means 17, for printing T-shirt fronts or backs, and a T-shirt sleeve receiving platen 18, associated with another silk screen holding mechanism 19, for printing the sleeves of T-shirts. Of course according to the present invention the device 10 may be simplified so that only the frame portion 11, with elongated bar 12 and screen receiving position 13, are provided, although by providing other stations (e.g. 16. 18) for the same machine its versatility is enhanced.

Shown mounted on the bar 12 in FIG. 1 are a painter's cap top printing platen assembly, shown generally by reference numeral 21, and a cap front printing device, shown generally by reference numeral 22, according to the present invention. The device 21 can be seen from an inspection of FIGS. 1-3, and will be described for utilization with reference to the painter's cap 24 illustrated in FIG. 4.

The conventional painter's cap 24 illustrated in FIG. 4 includes a bill 25, an interior sweatband (not shown), a front 26, and a large top 27, with a hem 28 being provided between the front 26 and top 27, and the hem 28 being spaced a distance D from the bill 25. Note that the top 27 is essentially oval. All portions of the bill 25 at the front 26 are substantially equidistant (distance D) from a corresponding portion of the hem 28. The top 27 has generally the same area as the head-receiving opening (not shown) at the sweatband. This conventional painter's cap differs from a conventional baseball-type cap which comprises a bill, a sweatband, and distinct panels, including a front panel, attached together at their sides, and at the top at a generally common point.

The platen assembly 21 according to the invention includes a platen 30 having an oval configuration in plan, the oval of the platen 30 having dimensions generally corresponding to the dimensions of the oval top 27 of the completed painter's cap 24 with which it is to be utilized. The platen 30 includes a smooth hard top surface 31, of a conventional platen material (such as used for conventional T-shirt platens 16, 18), and a base 32, a taper 33 being provided along the entire periphery of the base 32 at the edge of the top surface 31. An elongated support member 34 is affixed to the base 32 on the opposite side of the base 32 as the top 31. This may be accomplished by screws 35 (see FIG. 2) passing through a metal plate 36 affixed to one end of the support member 34.

The device 21 preferably is mounted for adjustable positioning along—and removal from—the bar 12. This is preferably provided by utilizing a collar 37 affixed to the opposite end of the elongated support member 34 as the platen 30. The collar 37 preferably has the same cross-sectional configuration as the bar 12—e.g it is quadrate in cross-section as illustrated in FIG. 2—and means are provided for operatively affixing the collar 37 to the elongated frame member 12 received thereby. Such affixing means preferably take the form of a plurality of screws 38 which extend through sides of the collar 37, the screws having enlarged ends 39, adapted to abut the elongated frame member 12, at one end thereof, and thumb screws 40 at the other ends thereof. At least two of the screws 38 extend in intersecting planes.

Utilizing the mechanism 21, a method of imprinting the top 27 of a completed painter's cap 24 may be practiced according to the invention. The method comprises the following steps: (a) Mounting the painter's cap 24 on the platen 30 so that the platen 30 is interior of the painter's cap 24 and engages the bottom of the top portion 27 thereof. (b) Affixing the painter's cap 24 with respect to the platen 30 so that top 27 of the painter's cap is essentially smooth and in contact with the platen 30 so that there is essentially no relative movement between the cap top 27 and the platen 30. This is preferably accomplished b applying—e.g. spraying-adhesive onto the top of the platen 30 prior to practicing step (a), and pressing the bottom of the top portion 27 of the cap 24 onto the adhesive. The spray adhesive to be used may be any conventional spray adhesive used with conventional T-shirt platens 16, 18, or the like. (c) Pivoting the silk screen holding mechanism 13 so as to bring the silk screen into contact with the top 27 of the painter's cap 24 (see the position 14 for a silk screen illustrated schematically in FIG. 1) to thereby print indicia on the top of the painter's cap: and (d) removing the painter's cap 24 from the platen 30 after printing by manually grasping it and pulling upwardly, the adhesive releasing.

Utilizing the invention it is possible to effectively and accurately print the tops of completed painter's caps 24 utilizing a silk screen.

The device 22 for printing cap fronts is illustrated most clearly in FIGS. 1 and 5 through 8. The device 22 includes a frame component 43, a saddle shown generally by reference numeral 44 in FIGS. 5-7 and a registration plate 45 (see FIGS. 1 and 5). The basic components of the device 22 for receiving a cap to be printed are basically the same as disclosed in U.S. Pat. No. 4,438,693, the disclosure of which is hereby incorporated by reference herein. In particular, the saddle 44, which is secured to the frame member 43, has a flat printing plate 47 (i.e. flat platen) which supports the front (e.g. 26 of the cap 24) of a cap to be printed therewith. The bill (e.g. 25) of the cap associated with the device 22 presses against the registration plate 45 when the cap is mounted on the saddle 44, the registration plate 45 being secured to the frame component 43 in a spaced-apart perpendicular relationship with the printing plate 47 so as to define a channel 48 therebetween for receiving the sweatband of the cap. The device 22 also includes means for blocking a cap mounted thereon, the blocking means including a pair of side forming members 49, 50 (see FIGS. 5–7) for shaping the sides of a mounted cap.

The device 22 according to the present invention differs from the cap-front printing mechanism described in said patent in the following manners:

(1) The platen 47 has a substantially linear rear edge portion 51 (see FIGS. 5 and 6) opposite the registration plate 45. The rear edge portion 51 is shaped and positioned with respect to the registration plate 45 so that a painter's cap 24 front 26 may lay flat thereon, with no portion of the platen 47 interfering with the hem 28 of the cap 24. That is the dimension D' (see FIG. 5) is slightly less than D.

In order to make the device 44 so that it is versatile—that is can also be used for printing baseball-type caps which require a mechanism for shaping the top thereof while the front is being printed—a platen 47 rear blocking member 52 is also preferably provided. The rear blocking member 52 preferably comprises a plate having a trapezoid shape in plan, as illustrated clearly in FIG. 6, including a first base 53 and a second base 54, with the sides 55 tapering from the first base 53 to the second base 54. Means are also provided for mounting the rear blocking member 52 so that it is movable from a first position (FIGS. 1, 5, and 7) wherein it operatively engages the edge 51 (i.e. base 53 engages edge 51) to provided an extension thereof, to a second position (FIGS. 6 and 8) wherein it is completely out of operative engagement with the edge 51. The mounting means preferably comprise at least one guide member—and preferably a pair of guide members 56—mounted to the trapezoil plate 52, and guide means 57 (see FIGS. 6 and 7) mounted to the underside of the saddle plate 47.

The guide means 57 operatively engage the guide members 56 to provide relative linear movement between the trapezoid plate 52 first base 53, and the saddle plate rear edge portion 51. Preferably the cross members 58 of the guide means 57 are spaced from the bottom of the platen 47 approximately the same distance as the thickness of the guide members 56, so that an interference fit is provided between the guide members and the cross members 58. Of course any accessory latching means may be provided for latching the rear blocking trapezoid plate 52 in place in association with the platen 47, if desired.

(2) Instead of the saddle 44 being mounted at a specific distance with respect to the means 13 for movably securing a silk screen to the frame 11, 43, a saddle 44 is mounted so that its position with respect to the means 13 along the elongated frame bar 12, may be adjusted, and the device 22 can be removed from the bar 12. This is accomplished by providing a collar 60 mounted to the opposite end of the frame component 43 as the registration plate 45. The collar 60 is preferably essentially identical to the collar 37, including having a quadrate cross-section, and a plurality of screws 61 with thumbscrew portions 62, at least two of the screws disposed in intersecting planes.

Figure 6:
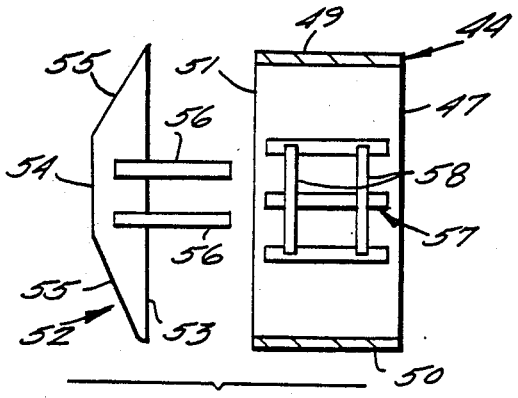
FIG. 6 is a cross-sectional view taken along lines 6—6 of FIG. 5, of only the saddle portion of the device of FIG. 5, and showing a rear blocking component thereof detached from the saddle.
Figure 8:
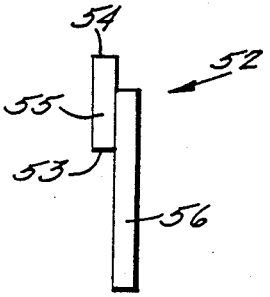
FIG. 8 is a side view of the detached rear blocking member of FIG. 6.
Figure 7:
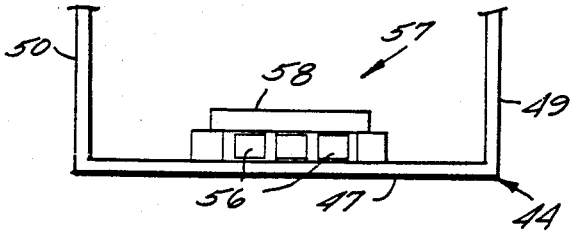
FIG. 7 is a rear end view, taken in the direction of arrow 7—7 of FIG. 5, of the saddle of the device of FIG. 5.

In utilizing the device 22, when the front panel of a baseball-type cap is to be printed the rear blocking member 52 is moved so that the base 53 thereof is in contact with the rear edge 51 of the plate 47. When the front 26 of a painter's cap 24 is to be printed the rear blocking member 52 is detached—as illustrated in FIGS. 6 and 8.

Utilizing the apparatus 10 according to the present invention, it is possible to print the top 27 of one painter's cap 24 while simultaneously printing the front 26 of another painter's cap 24 (or in fact the front panel of a baseball-type cap). This is preferably effected by providing the support member 34 and frame component 43 so that they establish the same working heights for the platen top surface 31 and the saddle flat platen 47. This relative position is illustrated in FIG. 1. With the working heights of the surfaces 31, 47 essentially the same, the linear positions of the devices 21, 22 along the frame bar 12 are adjusted by loosening the screws 38, 61, sliding the components 21, 22 along the bar 12, and then tightening the screws 38, 61. A silk screen mounted by the means 13 may then be pivoted into operative association with the top 27 of a cap received by the platen 30 at the same time it is moved into operative association with the front 26 of a cap received by the platen 47 (see position 14 in FIG. 1).

If desired, it is also possible to provide either of the support members 34 or frame component 43 so that they are detachable from their respective collars 37, 60, so that the same collar 37, 60 may be utilized with different components (e.g. a collar 37 could be utilized with a saddle 44 instead of platen 30), or differently dimensioned components. It will thus be seen that according to the present invention a method and apparatus have been provided for the effective printing of both painter's caps tops and fronts. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A cap printing device for screen printing onto the front of a cap of the type having a sweatband and a bill including a painter's cap, having a generally oval top, a bill, a sweatband, a front, and a hem between the front and top all portions of the bill at the front substantially equidistant from a corresponding portion of the hem; said device comprising:

a frame member:

a saddle secured to the frame member for mounting the cap for printing, said saddle having a flat platen which supports the front of the cap when the cap is so mounted;

a registration plate against which the bill of the cap presses when the cap is mounted on said saddle, said registration plate being secured to said frame in a spaced-apart perpendicular relationship with said platen so as to define a channel therebetween for receiving the sweatband of the cap;

a means for movably securing a printing screen to said frame for movement between an advanced position wherein the screen contacts the front of a cap mounted on said saddle, and a retracted position wherein the screen is withdrawn for changing caps; and said saddle platen having a substantially linear rear edge portion opposite said registration plate said rear edge portion shaped and positioned with respect to said registration plate so that a painter's cap front may lay flat thereon, no portion of said saddle platen interferingwith the hem of the cap.

2. A device as recited in claim 1 also for use with a baseball-type cap which comprises a bill, a sweatband, and distinct panels, including a front panel, attached together at their sides, and at the top at a generally common point; said device further comprising a saddle platen rear blocking member for shaping the top of a baseball-type cap; and means for mounting said rear blocking member with respect to said saddle platen so that said rear blocking member is movable from a first position wherein it operatively engages said rear edge portion of said saddle platen, and provides an extension thereof, to a second position wherein it is completely out of operative engagement with said rear edge portion.

3. A device as recited in claim 2 wherein said rear blocking member comprises a plate having a trapezoid shape in plan, said trapezoid shape including a base portion which engages said rear edge portion in said first position of said rear blocking member, and side edges tapering from said first base portion to a second base portion having a length less than that of said first base portion.

4. A device as recited in claim 3 wherein said means for mounting said trapezoid plate for relative movement with respect to said platen comprises at least one guide member mounted to said trapezoid plate, and guide means mounted to the underside of said platen, said guide means operatively engaging said guide member to provide relative linear movement between said trapezoid plate portion first base and said platen rear edge portion.

5. A device as recited in claim 2 wherein said means for mounting said rear blocking member for relative movement with respect to said platen comprises a guide member operatively attached to said rear blocking member, and guide means formed on the bottom of said platen, for operatively engaging said guide member to effect linear guided movement of said rear blocking member toward and away from said platen rear edge portion.

6. A device as recited in claim 2 further comprising an elongated support member operatively attached to said saddle and said registration plate at one end thereof, and a collar operatively attached to said elongated support member at the end thereof opposite said registration plate and said saddle; and means associated with said collar for operatively affixing said collar to said frame member at various adjusted positions along said frame member with respect to said means for movably securing a silk screen to said frame member.

7. A device as recited in claim 1 further comprising an elongated support member operatively attached to said saddle and said registration plate at one end thereof, and a collar operatively attached to said elongated support member at the end thereof opposite said registration plate and said saddle; and means associated with said collar for operatively affixing said collar to said frame member at various adjusted positions along said frame member with respect to said means for movably securing a silk screen to said frame member.

8. A device as recited in claim 1 wherein said saddle further comprises means for blocking a cap mounted thereon, said blocking means including a pair of side forming members connected to said platen in an opposed relationship to one another for shaping the sides of a mounted cap.

9. A device as recited in claim 1 further comprising an elongated support member operatively attached to said saddle at one end thereof, and a collar operatively attached to said elongated support member at the end thereof opposite said registration plate and said saddle; and means associated with said collar for operatively affixing said collar to said frame member at various adjusted positions along said frame member with respect to said means for movably securing a silk screen to said frame member.

10. A method of imprinting the top of a completed painter's cap which has a generally oval top, a bill, a sweatband a front and a hem between the front and top, the top having generaly the same area as a head-receiving opening at the sweatband; utilizing a flat platen having a configuration generally corresponding to the configuration of the painter's cap top, and utilizing a printing screen; said method comprising the steps of;

(a) mounting a painter's cap on the flat platen so that the platen is interior of the painter's cap and engages the bottom of the top portion of the painter's cap;

(b) affixing the painter's cap with respect to the platen so that the top of the painter's cap is essentially smooth and in contact with the flat platen so that there is essentially no relative movement between the cap top and the platen;

(c) bringing the screen into contact with the top of the painter's cap while mounted on the platen to thereby print indicia onto the top of the painter's cap; and (d) removing the painter's cap from the platen after printing.

11. A method as recited in claim 10 wherein step (b) is practiced by applying an adhesive onto the top of the platen, and pressing the bottom of the top portion of the painter's cap onto the adhesive.

12. A method as recited in claim 11 wherein said adhesive applying step is practiced by spraying adhesive onto the top of the platen.

13. A cap printing device for silk screen printing onto the front panel of a cap of the type having a sweatband and a bill, comprising: a frame member; a substantially flat platen operatively attached to the frame member for mounting the cap for printing, said flat platen supporting the front panel of a cap when the cap is mounted thereon; blocking means for blocking a cap mounted on the platen, said blocking means comprising a rear forming member for shaping the top of a cap mounted on the platen; said rear forming member including a trapezoidal plate having a straight edge, and a non-linear edge surface for engaging a cap, said non-linear edge surface opposite said straight edge; means for mounting said trapezoidal plate for relative movement with respect to said platen, and removal from said platen; a first straight edge of said platen cooperating with said straight edge of said trapezoidal plate when said trapezoidal plate is mounted as an extension of said platen, and a second straight edge of said platen opposite said first straight edge thereof.

14. A device as recited in claim 13 also for use with a baseball-type cap which comprises a bill, a sweatband, and distinct panels including a front panel, attached together at their sides, and at the top at a generally common point; said device further comprising a saddle platen rear blocking member for shaping the top of a baseball-type cap; and means for mounting said rear blocking member with respect to said saddle platen so that said rear blocking member is movable from a first position wherein it operatively engages said rear edge portion of said saddle platen, and provides an extension thereof, to a second position wherein it is completely out of operative engagement with said rear edge portion.

15. A device as recited in claim 14 wherein said rear blocking member comprises a plate having a trapezoid shape in plan, said trapezoid shape including a base portion which engages said rear edge portion in said first position of said rear blocking member, and side edges tapering from said first base portion to a second base portion having a length less than that of said first base portion.

16. A device as recited in claim 15 wherein said means for mounting said trapezoid plate for relative movement with respect to said platen comprises at least one guide member mounted to said trapezoid plate, and guide means mounted to the underside of said platen, said guide means operatively engaging said guide member to provide relative linear movement between said trapezoid plate portion first base and said platen rear edge portion.

* * * * *